US005323861A

United States Patent [19]

Kaidonis et al.

[11] Patent Number: 5,323,861

[45] Date of Patent: Jun. 28, 1994

[54] METHOD FOR PROTECTING AN AREA, IN PARTICULAR AGAINST FIRE, AND EQUIPMENT FOR THE IMPLEMENTATION THEREOF

[75] Inventors: Aristide Kaidonis, Eguilles; Eric Issartel, Aubenas, both of France

[73] Assignee: Zeus, Eguilles, France

[21] Appl. No.: 31,117

[22] Filed: Mar. 12, 1993

Related U.S. Application Data

[62] Division of Ser. No. 703,868, May 23, 1991, Pat. No. 5,211,336.

[51] Int. Cl.[5] ..... A62C 2/00

[52] U.S. Cl. ..... 169/45

[58] Field of Search ..... 169/45, 43, 16

[56] References Cited

U.S. PATENT DOCUMENTS

| | | | |
|---|---|---|---|
| 3,621,918 | 11/1971 | Damron | 169/45 X |
| 3,788,542 | 1/1974 | Mee . | |
| 4,037,787 | 7/1977 | King . | |
| 4,378,851 | 4/1983 | de Vries | 169/45 |
| 4,473,188 | 9/1984 | Ballu . | |
| 4,610,310 | 9/1986 | Miller et al. . | |
| 4,659,012 | 4/1987 | Coffee . | |
| 4,710,849 | 12/1987 | Norris . | |
| 4,907,654 | 3/1990 | Eberhardt . | |
| 4,944,460 | 7/1990 | Steingass . | |
| 5,165,482 | 11/1992 | Smagac et al. | 169/16 X |

FOREIGN PATENT DOCUMENTS

| | | | |
|---|---|---|---|
| 1149649 | 12/1957 | France . | |
| 1434880 | 2/1966 | France . | |
| 2624750 | 6/1989 | France | 169/45 |
| 1135929 | 12/1968 | United Kingdom . | |

OTHER PUBLICATIONS

Popular Science, Oct. 1971, p. 32, "Can 'Charged Water' Clear Our Air?".

*Primary Examiner*—David M. Mitchell
*Assistant Examiner*—Gary C. Hoge
*Attorney, Agent, or Firm*—Stevens, Davis, Miller & Mosher

[57] ABSTRACT

Method for protecting an area, in particular against fire, by emission of a cloud of water droplets, comprising at least two of the three successive stages, in an order which is appropriate to the problem faced:

a first stage, corresponding to remote fire prevention, in which droplets are emitted which are smaller than 100 micrometers, suitable in particular for rehydrating plants, a second stage, used in proximal prevention, which comprises in addition the emission of droplets of 100 to 300 micrometers, giving a more long lasting mist, and a third stage, for immediate prevention, in which droplets of 300 to 800 micrometers are added to the previous droplets, for a drizzle effect.

6 Claims, 1 Drawing Sheet

METHOD FOR PROTECTING AN AREA, IN PARTICULAR AGAINST FIRE, AND EQUIPMENT FOR THE IMPLEMENTATION THEREOF

This is a Divisional of application Ser. No. 703,868 filed May 23, 1991 now U.S. Pat. No. 5,211,336.

BACKGROUND OF THE INVENTION

The present invention relates to a method for protecting an area, in particular against fire or pollution, or against the dehydration of the plants which it contains, by emission, over the area to be protected, of a cloud of water droplets.

Protection against fire, pollution or dehydration by spraying water in the form of water or droplets has been known for a very long time, but it seems that hitherto no particular attention has been paid to the influence of the size of the drops and droplets.

The research which has been carried out for the present invention and which concerned the combating of fire has demonstrated that this size could have a considerable importance. The object of the present invention, which results from this research, is to provide a method of protection which permits a considerable improvement in the efficiency of the protection for an equal consumption of liquid.

SUMMARY OF THE INVENTION

In order to achieve this result, the invention provides a method of the type described at the beginning, and which comprises at least two of the three following stages, in an order which is appropriate to the problem faced:

- a first stage in which the droplets emitted essentially have a diameter less than 100 micrometers,
- a second stage in which the droplets emitted essentially comprise 10 to 50% by weight of droplets of a diameter less than 100 micrometers, and the remainder of droplets of a diameter lying between 100 and 300 micrometers,
- a third stage in which the droplets emitted essentially comprise 3 to 20% by weight of droplets of a diameter less than 100 micrometers, 20 to 50% by weight of droplets of a diameter lying between 100 and 300 micrometers, and the remainder of droplets of a diameter lying between 300 and 800 micrometers.

The protection of plants, and in particular of forests, against fire must have several forms depending upon the imminence of the danger.

Times of great heat and great drought are particularly favorable to the propagation of fire. The fire may not yet have begun in the vicinity, or alternatively be sufficiently far away that its existance is manifested only by a rise in temperature resulting from the arrival of air heated up in the vicinity of a fire and carried by the wind. The vegetation is then subjected to a "hydric stress" and then combats the heat initially by an emission of water vapor and then, when the reserves of water in the foliage are exhausted, by a vaporization of volatile organic compounds, in particular terpenes, which unfortunately are combustible, in particular in the case of resinous plants.

Measures must then be taken which are termed "remote prevention". These measures will comprise, according to the method of the invention, the emission of droplets of very fine dimension, essentially of dimensions less than 100 micrometers. These droplets have several effects: owing to their size, they are easily absorbed directly by the stomata of the leaves and reduce the hydric stress, consequently delaying proportionately the emission of combustible vapors. Furthermore, they absorb or reflect solar radiation, which lowers the temperature. A consequence of this absorption of solar radiation is the vaporization of the droplets, which increases the content of water vapor in the atmosphere. This provides yet another beneficial effect since the water vapor itself stops some of the infrared rays.

When the fire approaches to the point where the infrared radiation emitted by the flames can begin to be felt, "proximal protection" measures must be taken in order to counteract this additional heating. This will be obtained, according to the invention, by adding to the very fine droplets of the remote prevention droplets of larger dimensions, between 100 and 300 micrometers. These droplets of greater dimensions will provide a more long lasting mist since they take longer to evaporate and are more opaque to the infrared radiation emitted by the flames and by the sun.

Lastly, if unfortunately the fire has continued to progress, recourse must be had to so-called "immediate prevention" measures which comprise the emission, in addition to the droplets emitted in the first two above-mentioned stages, of even larger droplets, 300 to 800 micrometers, in order to create a drizzle effect in which the leaves are effectively moistened.

In summary, for protection against fire, for remote prevention the first stage is implemented, for closer prevention the second stage is implemented, and for immediate prevention the third stage is implemented.

The dimensions of the droplets and their respective proportions in the different stages of the prevention must be selected as a function of the nature of the risk; temperature, hygrometry, type of the plant species to be protected, state of the environment, etc.

Whatever the risk, the prevention in successive stages according to the invention permits a more efficient combating than the current techniques, with a very considerable reduction in consumption. In the case where the emission of the mist takes place from fixed points, for example in the vicinity of dwellings, it can be automated, for example using temperature-sensitive sensors.

The favorable distribution should be preserved in the mist for as long as possible. However, some of the small droplets, instead of evaporating, combine under the effect of gravity, with the large ones and the latter, having grown, assume an appreciable fall speed, which causes the mist to disappear.

In order to avoid this disadvantage, an electrostatic charge of the same sign can be given preferably to all the droplets, this charge being sufficient to counteract the coalescence of the drops under the effect of gravity.

The invention can also be applied to the protection of an area against pollution, or to sprinkling, or more precisely to the combating of hydric stress. It will then be possible to eliminate, depending upon the circumstances, one or other of the above-described stages, or to modify their order.

Tests have shown that the method permits, by the creation of a drizzle effect, the precipitation in the form of rain of the liquid atmospheric pollutants since the droplets emitted during the pollution combine with the droplets emitted by the method.

The method can also be used during the emission of toxic or non-toxic dust and of organic or inorganic particles in order to precipitate them. The mist thus created above and around the area polluted by this dust precipitates the dust since the particles are made heavier when they come into contact with the water droplets.

It will be understood that the mist thus created above and around the contaminated area prevents any dispersion of the atmospheric pollutants which will be precipitated in neutralized forms at the locations where they were emitted or at a very short distance therefrom.

It can be seen that the distribution of the sizes of droplets of the mist emitted according to the invention must be appropriate each time to the nature of the pollutant: size and shape of the particles, more or less porous structure of these particles, surface-active effects, in order to obtain the precipitation.

When combating the dehydration of plants, it will be desired especially to prevent hydric stress, giving priority to the first and second stages.

The droplets formed during the implementation of the method consist, in principle, essentially of water. However, it is advantageously possible to provide for the cloud to contain combustion inhibitors and/or retardants, in the case of combating fire, or products capable of neutralizing the pollutants in the combating of pollution. These substances can be sprayed separately, or be mixed with water prior to being sprayed. In the case of sprinkling, it is also possible to use fertilizers or treatment products in combination with the water.

Implementation of the formation of the cloud of droplets according to the invention can be combined, if necessary, with the production of a foam, it being possible for the latter to be supplied separately or by using the equipment intended for the spraying, by adding a foaming agent to the water.

Because of its low water consumption, the method can also be used in the treatment of road surfaces against ice. A salt solution in water can then be sprinkled along and onto the roads, by vehicles or from fixed points. This use has the advantage of being economical in terms of the quantity of products consumed, and of avoiding pollution resulting from too much salt.

Lastly, the method can be used as a preventive treatment against the risks of explosion and fire occurring in premises or machine shops containing combustible particles which are sensitive to electrostatic phenomena. The mist created by the method of the invention prevents the formation of static electricity, eliminates the presence of the latter and prevents the kindling and the propagation of a fire or the triggering of an explosion.

The invention also provides equipment for the implementation of the method as has just been described, this equipment comprising, grouped in proximity to one another, a microatomizer capable of creating droplets of 5 to 100 micrometers, an atomizer capable of creating droplets of 100 to 500 micrometers, and a mist-sprayer capable of creating droplets of 500 to 800 micrometers, and an air-blowing means intended to create a current of air capable of carrying and mixing said droplets in order to form the cloud, the equipment furthermore comprising means for conveying the water to the microatomizers, atomizers and mist-sprayers.

DESCRIPTION OF THE PREFERRED EMBODIMENTS

Figure 1:
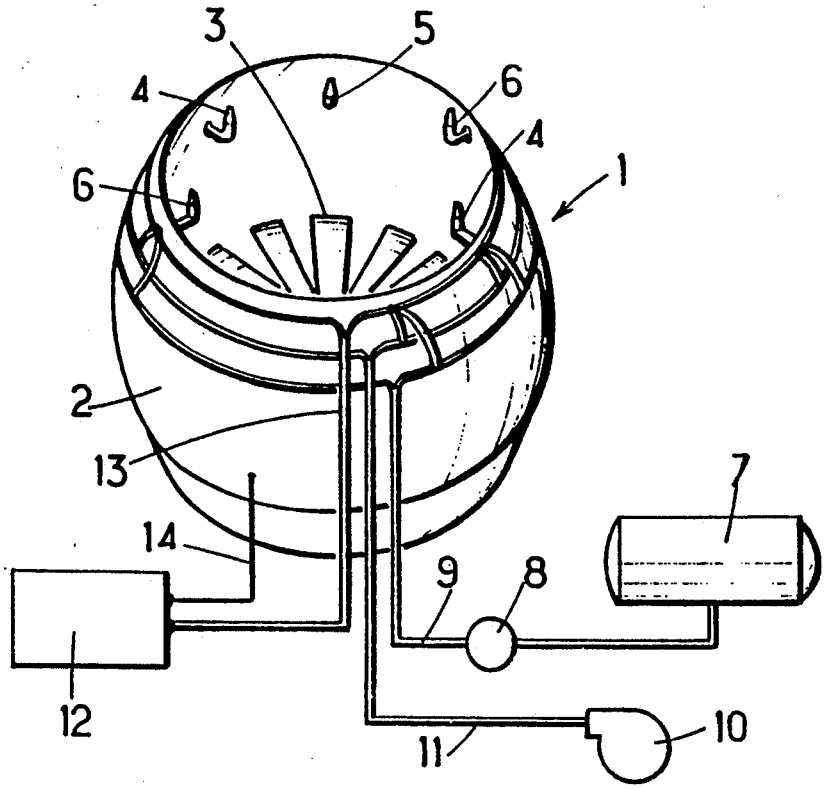
FIG. 1 is a diagrammatic perspective view of a device according to the invention.
Figure 2:
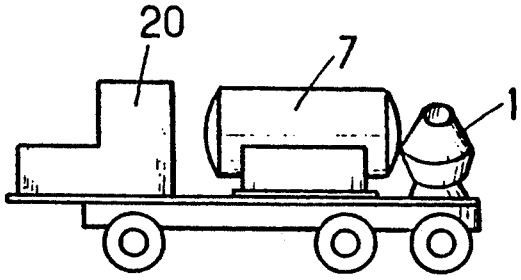
FIG. 2 is a diagram showing the device in FIG. 1 mounted on a vehicle.
Figure 3:
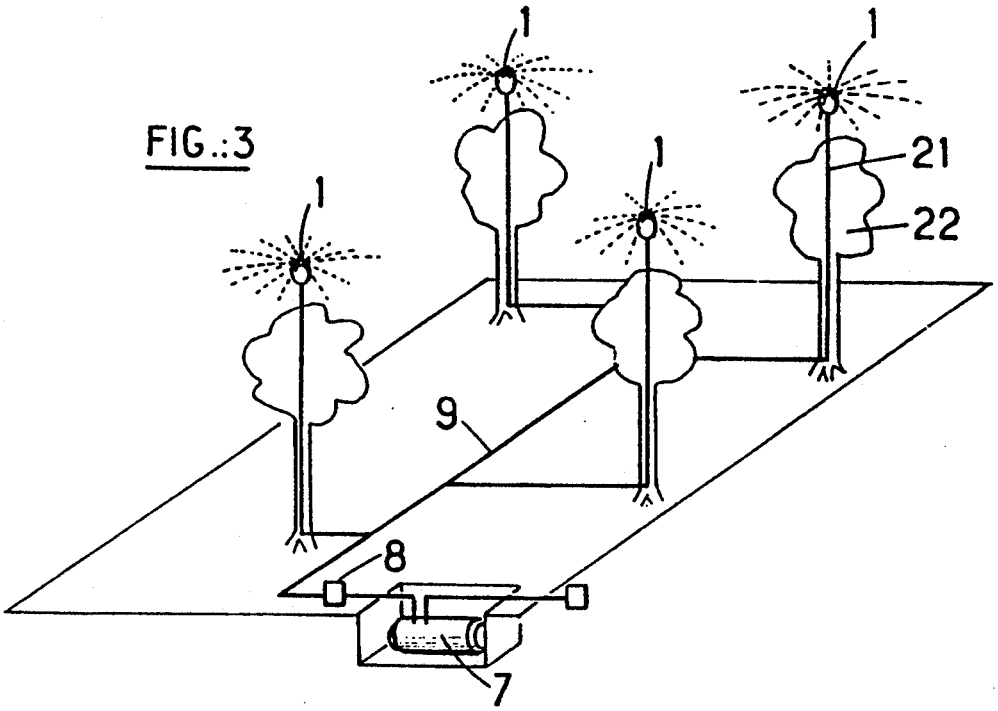
FIG. 3 is a view showing an installation with a plurality of devices mounted on telescopic supports.

The diagram in FIG. 1 shows a piece of equipment 1 comprising a barrel 2 which is open at both ends and which contains a fan 3.

Microatomizers 4, atomizers 5 and mist-sprayers 6 are mounted inside the barrel 2 in order to introduce droplets into the jet of air which is propelled by the fan. A water reservoir has been shown at 7 and a water pump at 8 which is connected to the reservoir 7 and to the droplet-producing means 4, 5, 6 in order to send water to them through pipes 9.

An apparatus for producing compressed air has been shown at 10 which is connected to the droplet-producing means 4, 5, 6, by a duct 11, and a generator of electrostatic potential has been shown at 12, one terminal of which is connected to the droplet-producing means by an insulated conductor 13 and to the barrel 1 by another conductor 14.

According to a first embodiment, the microatomizer is of a type comprising an injector of compressed air which is arranged in order to break up a stream of liquid into droplets, the jet of compressed air mixed with droplets then being sprayed by a diffuser, the equipment furthermore comprising means for producing the compressed air and for sending it to the injector.

According to another embodiment, the microatomizers is of a type in which a jet of water is injected into a system of sound waves created by sending a jet of compressed air at supersonic speed into a resonator, the equipment furthermore comprising means for producing compressed air and for sending it to the microatomizer. The compressed air emerges from a diverging conical nozzle placed coaxially with a cylindrical resonance chamber which is open towards this nozzle. When the speed of the air exceeds the speed of sound, a stationery train of sound shock waves is produced between the nozzle and the resonance chamber, and the water to be sprayed is injected into this wave train by a converging annular nozzle which is coaxial with and outside the nozzle for compressed air.

According to a third embodiment, the microatomizer is of a type in which water is sent at a pressure greater than 30 bar through a diffuser with an orifice of small diameter, a needle being arranged coaxially with the orifice of the diffuser in order to break up the jet of water emerging from said diffuser, the equipment furthermore comprising means for increasing the pressure of the water above 30 bar and for sending the water at this pressure to said diffuser. Such microatomizers are marketed by the company "DUTRIE PLANTS MARKETING", Steenwerk-France. They are capable of supplying extremely fine droplets, even to a greater extent than what is required here: 10 to 15 micrometers for a pressure of 40 bar, with a flow rate of approximately 5 liters/minute, 2 to 5 micrometers for a pressure of 70 bar, with a flow rate of approximately 7 liters/minute, the energy consumption is of the order of 1.5 $kW/m^3$ of water at 40 bar, and 2.5 $kW/m^3$ of water at 70 bar.

The choice from among these various embodiments, which are not equivalent, is a matter of appropriateness: the first embodiment makes use of robust and tested equipment, the second embodiment, and especially the third, make it possible to obtain very fine droplets more easily but at the price of a piece of equipment which can be rather more delicate and require more highly trained personnel.

Irrespective of the type of microatomizer used, it is preferred to use as the atomizer an apparatus of the type which comprises a rotary disk associated with a nozzle coaxial with this disk and arranged in order to send a jet of water toward the latter, the equipment furthermore comprising means for driving the disk in rotation.

Such apparatuses are described, in particular, in European Patent EP-A-0055948 and are marketed by the company TECNOMA under the name "GIROJET".

As for the mist-sprayer, an apparatus of known type will preferably be selected which comprises a plane, fixed deflector and a nozzle arranged in order to direct a jet of water obliquely toward the deflector.

In order to obtain the effect of electrification of the droplets, it is possible to provide for the diffusers, injectors or nozzles of the microatomizers, atomizers and mist-sprayers all to be made from a material which is capable of charging the water droplets electrostatically by friction of the jet of water or mist, the charges given to the droplets being of the same sign.

It is also possible to provide for these diffusers, injectors or nozzles of the microatomizers, atomizers and mist-sprayers to be electrically conductive and to be connected electrically to one another, the equipment furthermore comprising means capable of bringing them to a high electrostatic potential.

Each atomization point can be placed at an adjustable height, thus making it possible to cover an area of 0.5 to 5 hectares. The surface areas not being limitative since multiplication of the system is possible. The atomization points can be placed at different heights, on the ground, trees, posts, be set on the end of poles, or be carried by a land vehicle 20 (car, truck, tractor, with or without caterpillar tracks), and an air vehicle (aeroplane, helicopter, airship, captive balloon).

According to one advantageous embodiment, at least the diffusers, injectors or nozzles of the microatomizers, atomizers and mist-sprayers are mounted on telescopic supports 21 which move into an extended position, in which said diffusers, injectors or nozzles are in the optimum location with respect to the vegetation or to the objects to be protected, only when they are activated, said supports being at rest in a folded-up position in which the equipment is protected.

According to another advantageous embodiment, the equipment comprises means for activating automatically, and in an order determined in advance, the microatomizer, the atomizer and the mist-sprayer, as well as the blowing means, in response to the signals of sensors such as temperature sensors.

We claim:

1. Method for protecting an area against fire by forming a cloud of water droplets, which may contain an additive, over the area to be protected, the method comprising: emitting over the area to be protected at least two of the three following water droplet compositions, in an order which is predetermined:

a) droplets comprising a diameter of less than 100 micrometers, b) a combination of droplets comprising 10 to 50% by weight of droplets of a diameter of less than 100 micrometers, and the remainder of the droplets of a diameter of between 100 and 300 micrometers, c) a combination of droplets comprising 3 to 20% by weight of a diameter of less than 100 micrometers, 20 to 50% by weight of the droplets of a diameter between 100 and 300 micrometers, and the remainder of the droplets of a diameter between 300 and 800 micrometers.

2. The method according to claim 1, wherein as a fire moves from a remote position relative to a source to be protected from the fire, to positions closer to the source to be protected, the stages of a), b) and c) of claim 1 are effected in the order recited.

3. The method according to claim 1 in which applications a) and b) are made to combat the dehydration of vegetation in the area to be protected.

4. Method according to claim 1, in which an electrostatic charge of the same sign is given to all the droplets, this charge being sufficient to counteract the coalescence of the drops under the effect of gravity.

5. The method according to claim 1 wherein the stage b) is effected when the source to be protected is irradiated with infrared rays from the fire.

6. The method according to claim 1 wherein the stage a) is effected when the source to be protected from fire is vegetation, and the vegetation is subjected to "hydric stress" caused by the fire.

* * * * *